US011840989B2

(12) United States Patent
Endou et al.

(10) Patent No.: US 11,840,989 B2
(45) Date of Patent: Dec. 12, 2023

(54) HEAT EXCHANGER WITH PARTITION WALL INTERPOSED BETWEEN DIFFERENT FLOW PATHS

(71) Applicant: Honda Motor Co., Ltd., Tokyo (JP)

(72) Inventors: Tsuneo Endou, Saitama (JP); Kazuo Kikawa, Saitama (JP); Naoko Kasuya, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/337,395

(22) Filed: Jun. 2, 2021

(65) Prior Publication Data

US 2021/0381473 A1 Dec. 9, 2021

(30) Foreign Application Priority Data

Jun. 3, 2020 (JP) ..... 2020-097282

(51) Int. Cl.
*F28F 1/06* (2006.01)
*F28D 7/00* (2006.01)
(Continued)

(52) U.S. Cl.
CPC ..... *F02M 26/32* (2016.02); *F02M 26/28* (2016.02); *F28D 7/0025* (2013.01); *F28D 7/1692* (2013.01); *F28F 1/06* (2013.01)

(58) Field of Classification Search
CPC .... F28F 1/08; F28F 1/06; B33Y 80/00; F28D 7/0025
See application file for complete search history.

(56) References Cited

U.S. PATENT DOCUMENTS

2016/0158666 A1* 6/2016 Winandy ..... B01D 1/2887 202/185.1
2016/0290738 A1* 10/2016 Kupiszewski ..... F28F 13/12
(Continued)

FOREIGN PATENT DOCUMENTS

JP H08303981 11/1996
JP 2003097891 4/2003
(Continued)

OTHER PUBLICATIONS

"Notice of Reasons for Refusal of Japan Counterpart Application", dated Aug. 17, 2023, with English translation thereof, p. 1-p. 8.

*Primary Examiner* — Paul Alvare
(74) *Attorney, Agent, or Firm* — JCIPRNET

(57) ABSTRACT

Provided is a heat exchanger in which first flow paths for flowing a first fluid and second flow paths for flowing a second fluid are arranged adjacent via a partition wall through which heat exchange is performed. The partition wall includes parallel tubular partition walls inside of which is the first flow paths. At least a part of the tubular partition walls in a flow path direction are integrally coupled to form a partition wall coupling portion having a geometric pattern in transverse cross section. An element figure of the geometric pattern corresponding to a transverse cross-sectional shape of the tubular partition wall is connected to each other at a vertex, and the number of sides of the element figure gathering at the vertex is an even number. In the partition wall coupling portion, the second flow paths are defined between outer peripheral surfaces of the surrounding tubular partition walls.

16 Claims, 11 Drawing Sheets

(51) Int. Cl.

| | |
|---|---|
| ***F28D 7/16*** | (2006.01) |
| ***F02M 26/32*** | (2016.01) |
| ***F02M 26/28*** | (2016.01) |

(56) References Cited

U.S. PATENT DOCUMENTS

| | | | | |
|---|---|---|---|---|
| 2017/0205146 | A1 | 7/2017 | Turney et al. | |
| 2018/0238627 | A1 | 8/2018 | Herring et al. | |
| 2018/0266770 | A1* | 9/2018 | Wagner | F28D 7/0025 |
| 2021/0003349 | A1* | 1/2021 | Horoszczak | F28F 9/02 |
| 2021/0348856 | A1 | 11/2021 | Fujiwara | |

FOREIGN PATENT DOCUMENTS

| | | |
|---|---|---|
| JP | 2016528035 | 9/2016 |
| JP | 2019504287 | 2/2019 |
| WO | 2020059774 | 3/2020 |

* cited by examiner

HEAT EXCHANGER WITH PARTITION WALL INTERPOSED BETWEEN DIFFERENT FLOW PATHS

CROSS-REFERENCE TO RELATED APPLICATION

This application claims the priority benefits of Japanese application no. 2020-097282, filed on Jun. 3, 2020. The entirety of the above-mentioned patent application is hereby incorporated by reference herein and made a part of this specification.

BACKGROUND

Technical Field

The disclosure relates to a heat exchanger, and particularly relates to a heat exchanger, in which a partition wall is interposed between a plurality of first flow paths through which a first fluid flows and a plurality of second flow paths through which a second fluid flows, and heat exchange is performed between the first and second fluids through the partition wall.

Description of Related Art

Among the above heat exchangers, there are known a pipe-type heat exchanger (for example, see Patent Document 1), in which the inside and outside of a plurality of pipe-shaped partition walls are used as first and second flow paths, and a plate-type heat exchanger (for example, see Patent Document 2), in which mutual gaps between a plurality of plate-shaped partition walls that are arranged in parallel are used as alternately arranged first and second flow paths.

RELATED ART

Patent Documents

[Patent Document 1] Japanese Laid-Open No. 2016-528035
[Patent Document 2] Japanese Laid-Open No. 2019-504287

Problems to be Solved

In the conventional heat exchanger, in order to improve the heat transfer performance in the same volume, it is conceivable to, for example, make the heat transfer partition wall (the above-mentioned pipe-shaped or plate-shaped partition wall) thinner or reduce the partition wall gap to make the flow path cross section finer, so as to increase the number of heat transfer partition walls or increase the surface area of the entire partition wall.

However, such measures for improving the heat transfer performance may cause a decrease in the strength of the heat transfer partition wall, and may lead to inconvenience such as deformation of the heat transfer partition wall especially when the pressure difference between the first and second flow paths is large.

SUMMARY

According to the first feature of the disclosure, a heat exchanger is provided, in which a partition wall is interposed between a plurality of first flow paths through which a first fluid flows and a plurality of second flow paths through which a second fluid flows, and heat exchange is performed between the first fluid and the second fluid through the partition wall. The partition wall includes a plurality of tubular partition walls inside of which is the first flow paths and which are arranged in parallel to each other. At least a part of the plurality of tubular partition walls in a flow path direction are integrally coupled to each other to form a partition wall coupling portion having a geometric pattern in a transverse cross section. An element figure of the geometric pattern corresponding to a transverse cross-sectional shape of the tubular partition wall is connected to each other at a vertex of the element figure, and the number of sides of the element figure gathering at the vertex is an even number. In the partition wall coupling portion, the second flow paths are defined between the tubular partition walls surrounding the second flow paths.

Figure 7:
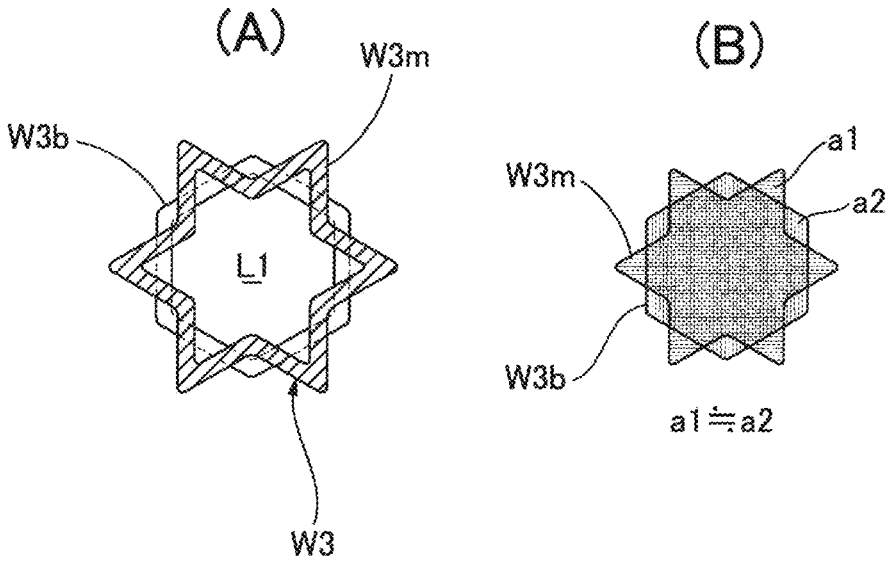

(A) of FIG. 7 is a transverse cross-sectional view of an intermediate portion of one tubular partition wall and (B) of FIG. 7 is an area comparison view showing the relationship between the transverse cross-sectional areas of the intermediate portion and two end portions of one tubular partition wall.

Figure 8:
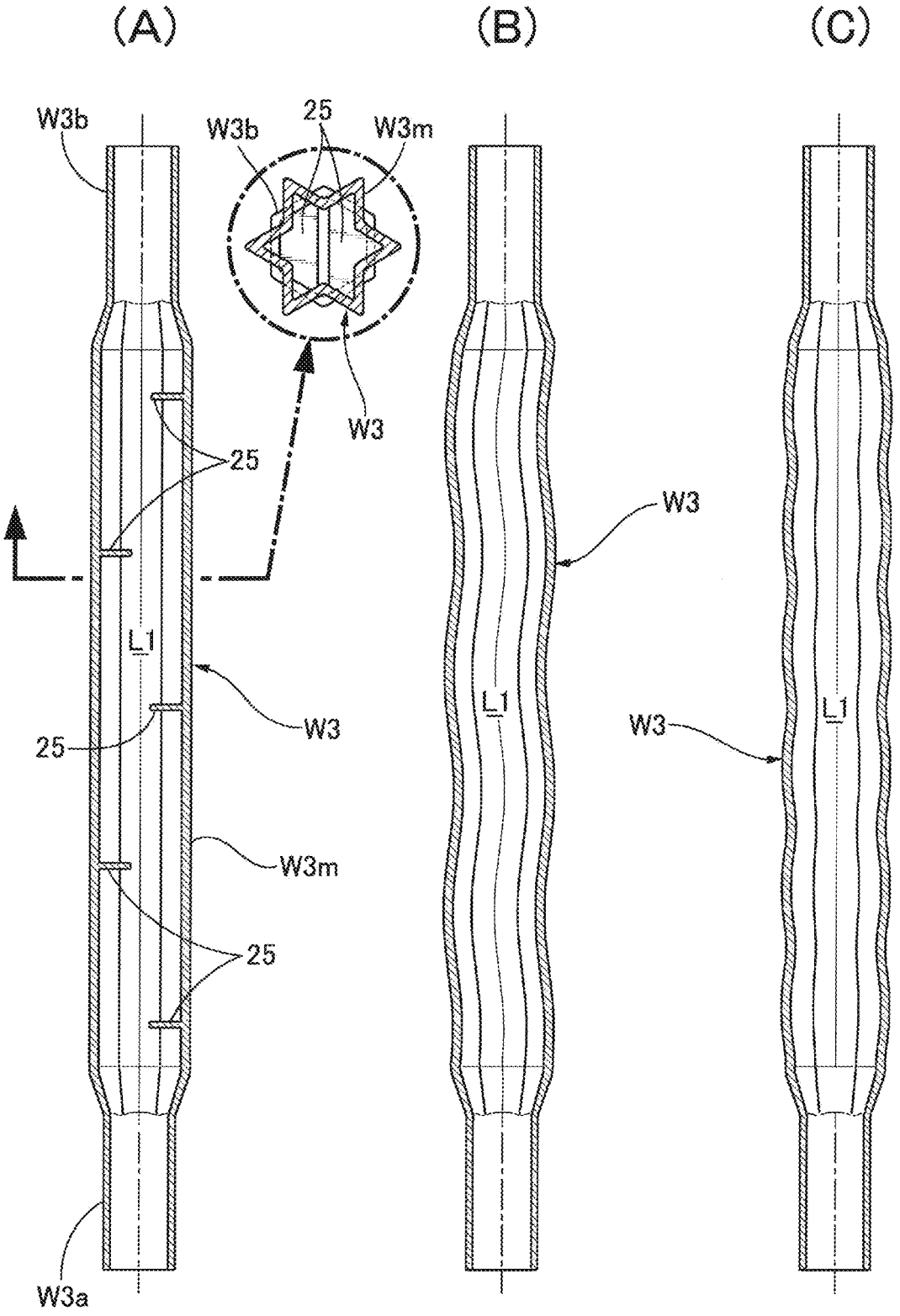

FIG. 8 shows variations of the tubular partition wall, wherein (A) shows a modified example having a protrusion on the inner peripheral surface of the partition wall, (B) shows a modified example in which the tubular partition wall is undulated in a wave form, and (C) shows a modified example in which the tubular partition wall is undulated in a herringbone form.

Figure 9:
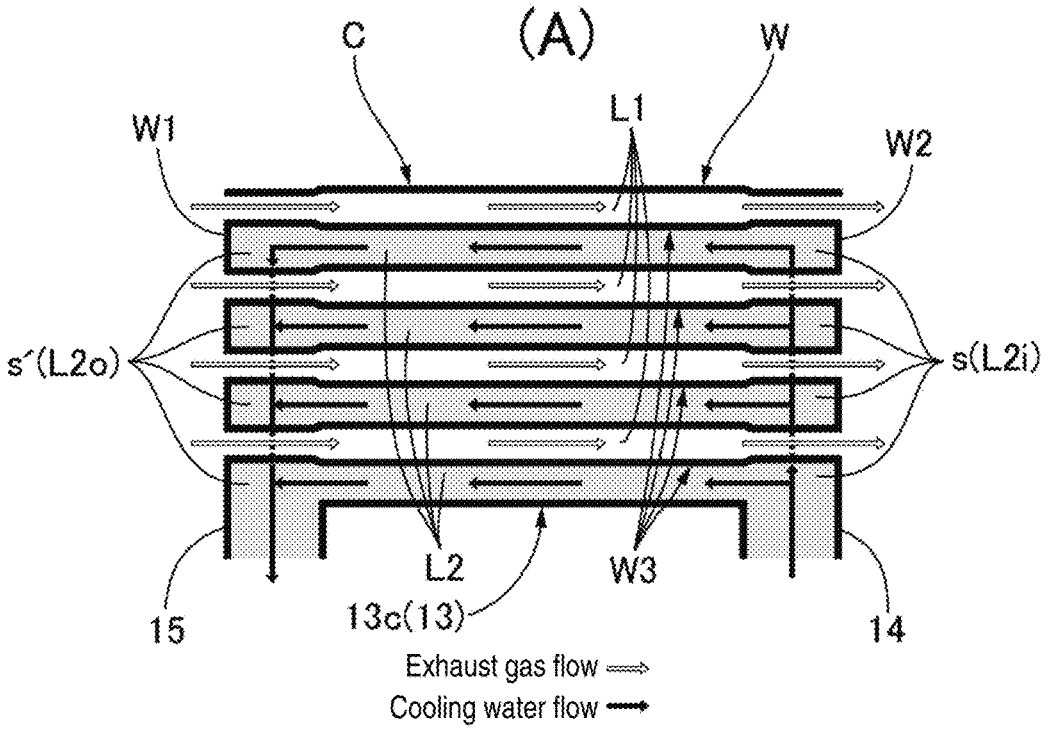
Figure 9:
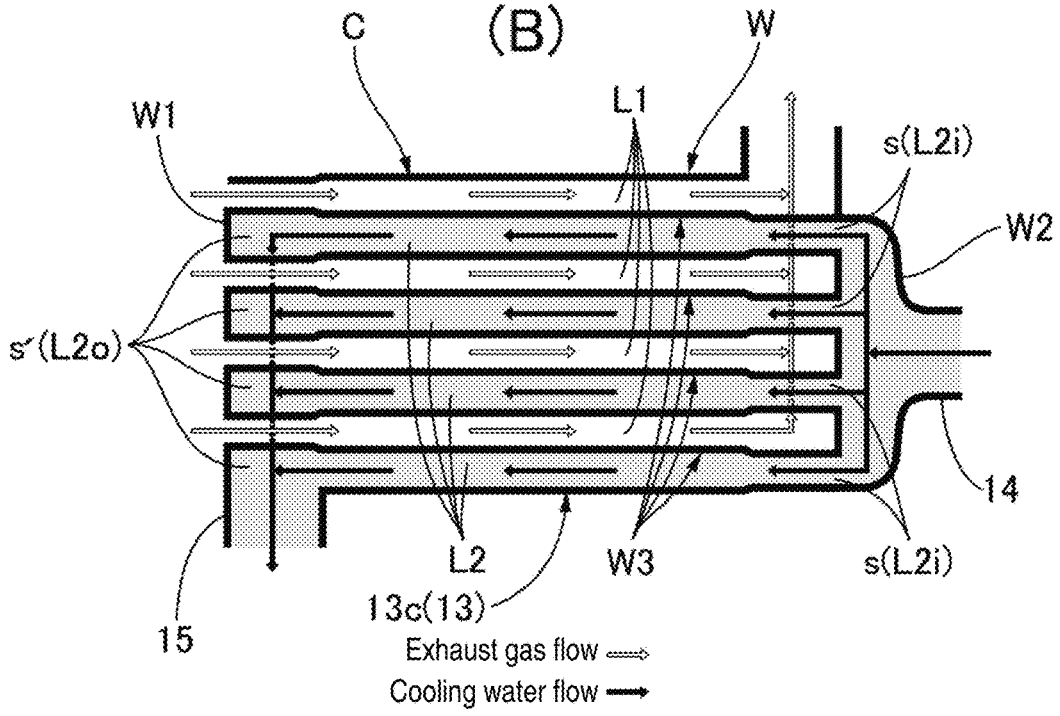

(A) of FIG. 9 shows a modified example in which the flow direction on the outlet side of the second flow path is changed and (B) of FIG. 9 shows a modified example in which the flow direction on each outlet side of the first and second flow paths is changed.

Figure 10:
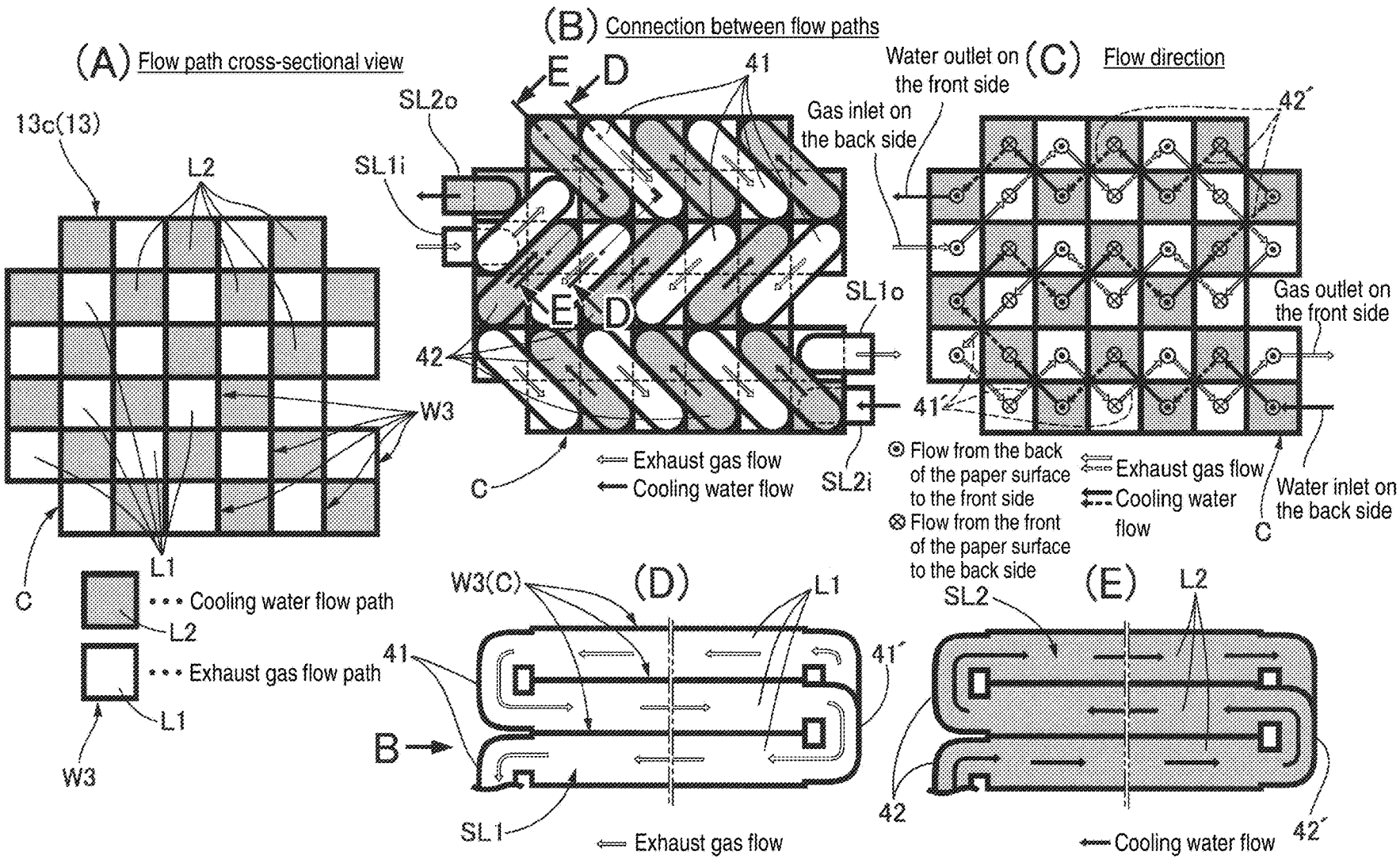

FIG. 10 shows an outline of the second embodiment of the heat exchanger of the disclosure, wherein (A) is a schematic transverse cross-sectional view of a partition wall coupling portion having a transverse cross-sectional grid shape, (B) is an explanatory view of the relationship of the connecting portions between the flow paths at one end portion of the partition wall coupling portion, (C) is an explanatory view of the flow directions in the first and second flow paths of the partition wall coupling portion, (D) is a vertical cross-sectional view of the first flow path (that is, a cross-sectional view along the line D-D of (B) of FIG. 10), and (E) is a vertical cross-sectional view of the second flow path (that is, a cross-sectional view along the line E-E of (B) of FIG. 10).

Figure 11:
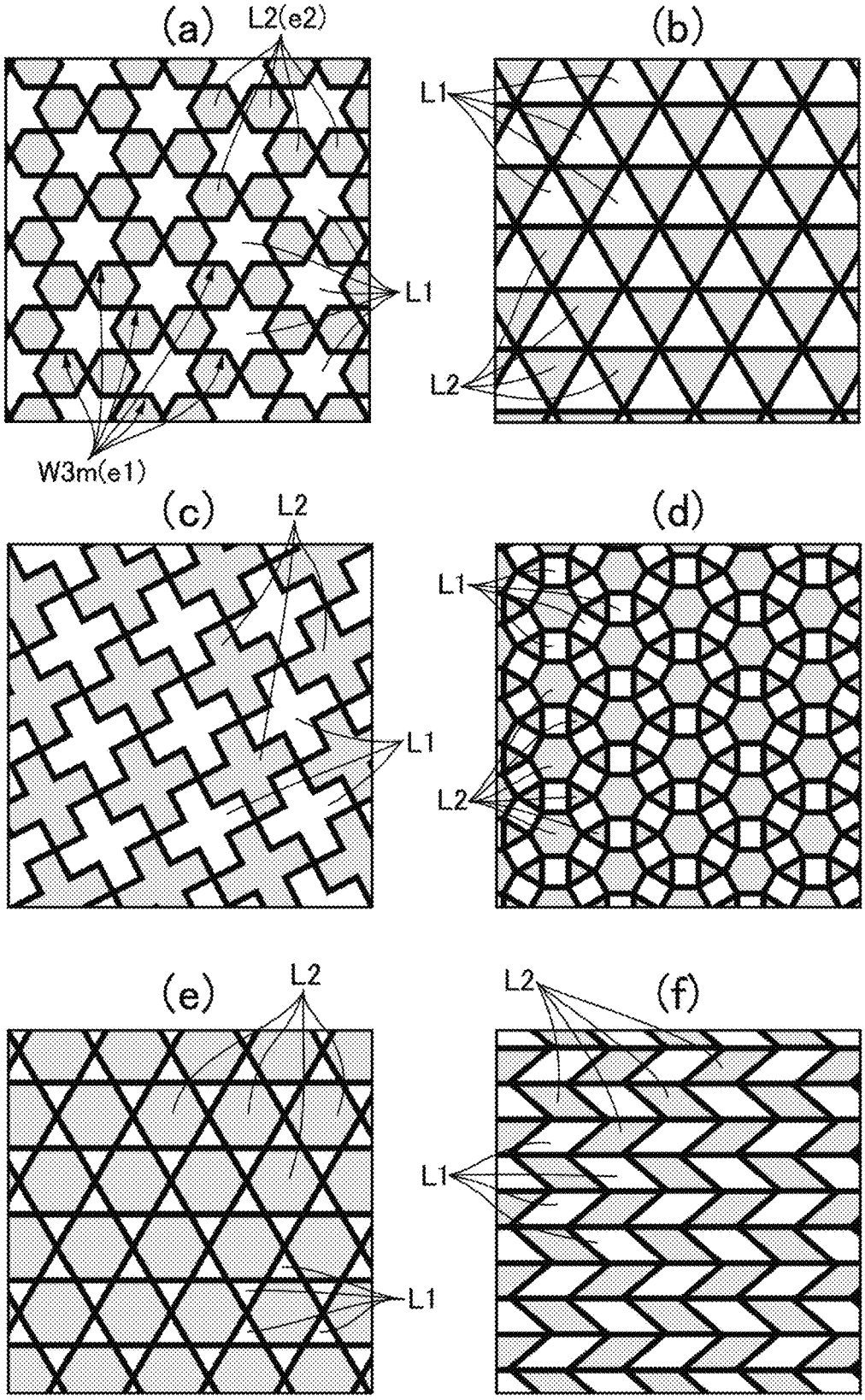

(a) to (f) of FIG. 11 are schematic transverse cross-sectional views showing variations of the geometric pattern of the transverse cross section of the partition wall coupling portion.

DESCRIPTION OF THE EMBODIMENTS

In view of the above conventional problems, the disclosure provides a heat exchanger.

Means for Solving the Problems

According to the first feature of the disclosure, a heat exchanger is provided, in which a partition wall is interposed between a plurality of first flow paths through which a first fluid flows and a plurality of second flow paths through which a second fluid flows, and heat exchange is performed between the first fluid and the second fluid through the partition wall. The partition wall includes a plurality of tubular partition walls inside of which is the first flow paths and which are arranged in parallel to each other. At least a part of the plurality of tubular partition walls in a flow path direction are integrally coupled to each other to form a partition wall coupling portion having a geometric pattern in a transverse cross section. An element figure of the geometric pattern corresponding to a transverse cross-sectional shape of the tubular partition wall is connected to each other at a vertex of the element figure, and the number of sides of the element figure gathering at the vertex is an even number. In the partition wall coupling portion, the second flow paths are defined between the tubular partition walls surrounding the second flow paths.

Further, in addition to the first feature, according to the second feature of the disclosure, by changing a flow path cross-sectional shape on a front side of at least one end portion of the tubular partition wall, each of the plurality of tubular partition walls forms a gap in a direction orthogonal to a flow path direction of the first flow paths between outer peripheral surfaces of the one end portions of the adjacent tubular partition walls. The gap forms an inlet space or an outlet space of the second flow paths which allows the second fluid to flow in or flow out from a side of the first flow paths, and in the partition wall coupling portion, the first and second flow paths extend in parallel and linearly with each other.

Further, in addition to the second feature, according to the third feature of the disclosure, in the partition wall coupling portion, the first fluid becomes a parallel flow and flows in one direction in the plurality of first flow paths, and the second fluid becomes a parallel flow and flows in the other direction in the plurality of second flow paths.

Further, in addition to the first feature, according to the fourth feature of the disclosure, in the partition wall coupling portion, one end portions and the other end portions of the adjacent first flow paths in the flow path direction are respectively connected to each other so that the plurality of first flow paths are connected in series with each other to form a first single flow path, and one end portions and the other end portions of the adjacent second flow paths in the flow path direction are respectively connected to each other so that the plurality of the second flow paths are connected in series with each other to form a second single flow path.

Further, in addition to the fourth feature, according to the fifth feature of the disclosure, in at least a partial region of the partition wall coupling portion, the first and second fluids flow in opposite directions in the adjacent first and second flow paths.

Further, in addition to the first feature, according to the sixth feature of the disclosure, the tubular partition wall integrally has a protrusion that protrudes into the first flow path for promoting heat transfer of the first fluid.

Further, in addition to the first feature, according to the seventh feature of the disclosure, at least a part of the tubular partition wall is undulated with respect to the flow path direction.

Further, in addition to the first feature, according to the eighth feature of the disclosure, by changing a flow path cross-sectional shape on each front side of one end portion and the other end portion of the tubular partition wall, each of the plurality of tubular partition walls forms a first gap and a second gap in a direction orthogonal to a flow path direction of the first flow paths between outer peripheral surfaces of the one end portions and the other end portions of the adjacent tubular partition walls. The first gap forms an inlet space of the second flow paths, and the second gap forms an outlet space of the second flow paths, and in the partition wall coupling portion, the first and second flow paths extend in parallel and linearly with each other.

Further, in addition to the eighth feature, according to the ninth feature of the disclosure, the partition wall coupling portion is divided into a plurality of partition wall coupling portion elements adjacent to each other with a small gap in between. Flow path direction intermediate portions of the adjacent partition wall coupling portion elements are integrally coupled to each other via a closed wall portion that fills a part of the small gap, and the closed wall portion blocks communication between the inlet space and the outlet space via the small gap.

Further, in addition to any one of the first to ninth features, according to the tenth feature of the disclosure, all of the partition wall including the partition wall coupling portion is integrally molded by metal lamination molding.

Effects

According to the first feature of the disclosure, in the heat exchanger including the plurality of tubular partition walls the inside of which is the first flow paths and which are arranged in parallel to each other, at least a part of the plurality of tubular partition walls in the flow path direction are integrally coupled to each other to form the partition wall coupling portion having the geometric pattern in the transverse cross section. The element figure of the geometric pattern corresponding to the transverse cross-sectional shape of the tubular partition wall is connected to each other at the vertex of the element figure, and the number of sides of the element figure gathering at the vertex is an even number. In the partition wall coupling portion, the second flow paths are defined between the tubular partition walls surrounding the second flow paths. As a result, in the partition wall coupling portion having the geometric pattern in the transverse cross section, the plurality of tubular partition walls are connected in all directions in the transverse cross section and integrated to form sturdy wall structures that reinforce each other so the rigidity and strength can be effectively increased as a whole. Accordingly, even when the tubular partition wall is made thinner to make the flow path cross section finer in order to improve the heat transfer performance, the rigidity and strength of the tubular partition wall can be sufficiently secured, and can be used even in a case of a large pressure difference between the first and second flow paths. As a result of the above, it is possible to provide an extremely high-performance heat exchanger that can secure sufficient heat transfer performance and rigidity and strength and can also achieve compactness and weight reduction.

Further, according to the second feature, by changing the flow path cross-sectional shape on the front side of at least one end portion of the tubular partition wall, each of the plurality of tubular partition walls forms the gap in the direction orthogonal to the flow path direction of the first flow paths between the outer peripheral surfaces of the one end portions of the adjacent tubular partition walls. The gap forms the inlet space or the outlet space of the second flow paths which allows the second fluid to flow in or flow out from a side of the first flow paths, and in the partition wall coupling portion, the first and second flow paths extend linearly. Therefore, the pressure loss in each flow path can be reduced. Moreover, the plurality of tubular partition walls can form the gap between the outer peripheral surfaces of one end portions of the adjacent tubular partition walls simply by changing the flow path cross-sectional shape on the front side of the one end portion, and use the gap as the inlet space or the outlet space of the second flow path. Therefore, the second fluid can smoothly flow in or flow out of the second flow path even from the side of the first flow path. Since the heat exchanger can effectively reduce the pressure loss at the inlet and outlet of the first and second flow paths as compared with the conventional plate-type heat exchanger, the heat exchanger can contribute to reduction of the pressure loss as a whole.

Further, according to the third feature, in the partition wall coupling portion, the first fluid becomes a parallel flow and flows in one direction in the plurality of first flow paths, and the second fluid becomes a parallel flow and flows in the other direction in the plurality of second flow paths. Therefore, the first and second fluids respectively flowing in the first and second flow paths are counterflows, and the heat exchange efficiency between the two fluids can be improved.

Further, according to the fourth feature, in the partition wall coupling portion, one end portions and the other end portions of the adjacent first flow paths in the flow path direction are respectively connected to each other so that the plurality of first flow paths are connected in series with each other to form the first single flow path, and one end portions and the other end portions of the adjacent second flow paths in the flow path direction are respectively connected to each other so that the plurality of the second flow paths are connected in series with each other to form the second single flow path. As a result, even for the partition wall coupling portion that has the geometric pattern, the plurality of first and second flow paths respectively become the connected first and second single flow paths (single paths) so the flow velocity can be increased to increase the thermal conductivity in particular when the flow rate is small.

Further, according to the fifth feature, in at least a partial region of the partition wall coupling portion, the first and second fluids flow in opposite directions in the adjacent first and second flow paths. Therefore, even if the first and second flow paths form the single flow paths (single paths), the first and second fluids respectively flowing through them are counterflows, and the heat exchange efficiency between the two fluids can be improved.

Further, according to the sixth feature, the tubular partition wall integrally has the protrusion that protrudes into the first flow path for promoting heat transfer of the first fluid. Therefore, the protrusion generates a turbulent flow to the first fluid in the first flow path to some extent, whereby the heat transfer coefficient can be improved while an increase in pressure loss is suppressed as much as possible.

Further, according to the seventh feature, at least a part of the tubular partition wall is undulated with respect to the flow path direction. Thereby, the first flow path is gently curved or the flow path cross-sectional area is gradually increased or decreased to generate a turbulent flow in the passing fluid to some extent, whereby the heat transfer coefficient can be improved while an increase in pressure loss is suppressed as much as possible.

Further, according to the eighth feature, by changing the flow path cross-sectional shape on each front side of one end portion and the other end portion of the tubular partition wall, each of the plurality of tubular partition walls forms the first gap and the second gap in the direction orthogonal to the flow path direction of the first flow paths between the outer peripheral surfaces of the one end portions and the other end portions of the adjacent tubular partition walls. The first gap forms the inlet space of the second flow paths, and the second gap forms the outlet space of the second flow paths, and in the partition wall coupling portion, the first and second flow paths extend linearly. Therefore, the pressure loss in each flow path can be reduced. Moreover, the plurality of tubular partition walls can respectively form the first and second gaps between the outer peripheral surfaces of one end portions and the other end portions of the adjacent tubular partition walls simply by changing the flow path cross-sectional shape on each front side of the one end portion and the other end portion, and use the first and second gaps as the inlet space and the outlet space of the second flow path. Therefore, the second fluid can smoothly enter and exit the second flow path even from the side of the first flow path. Furthermore, in particular, since the first fluid has a straight flow over the entire area from the inlet to the outlet of the first flow path, the pressure loss of the first flow path is minimized. As a result of the above, the heat exchanger can effectively reduce the pressure loss at the inlet and outlet of the first and second flow paths as compared with the conventional plate-type heat exchanger so the heat exchanger can contribute to reduction of the pressure loss as a whole.

Further, according to the ninth feature, since the small gap is formed between the plurality of partition wall coupling portion elements formed by dividing the partition wall coupling portion, the fluidity of the second fluid in the inlet space and the outlet space of the second flow path is enhanced, which can contribute to reduction of the pressure loss in the second flow path. In addition, since the closed wall portion that couples the adjacent partition wall coupling portion elements blocks the communication between the inlet space and the outlet space via the small gap, the closed wall portion can reliably prevent a short circuit between the inlet space and the outlet space due to the small gap, and as a result, the second fluid can flow reliably even in the intermediate portion of the second flow path.

Further, according to the tenth feature, all of the partition wall including the partition wall coupling portion is integrally molded by metal lamination molding. Therefore, the entire partition wall including the partition wall coupling portion, which has the geometric pattern in the transverse cross section and has a complicated three-dimensional form, can be integrally molded accurately by using a metal lamination molding method.

First, the first embodiment of the disclosure will be described below with reference to FIG. 1 to FIG. 7.

Figure 1:
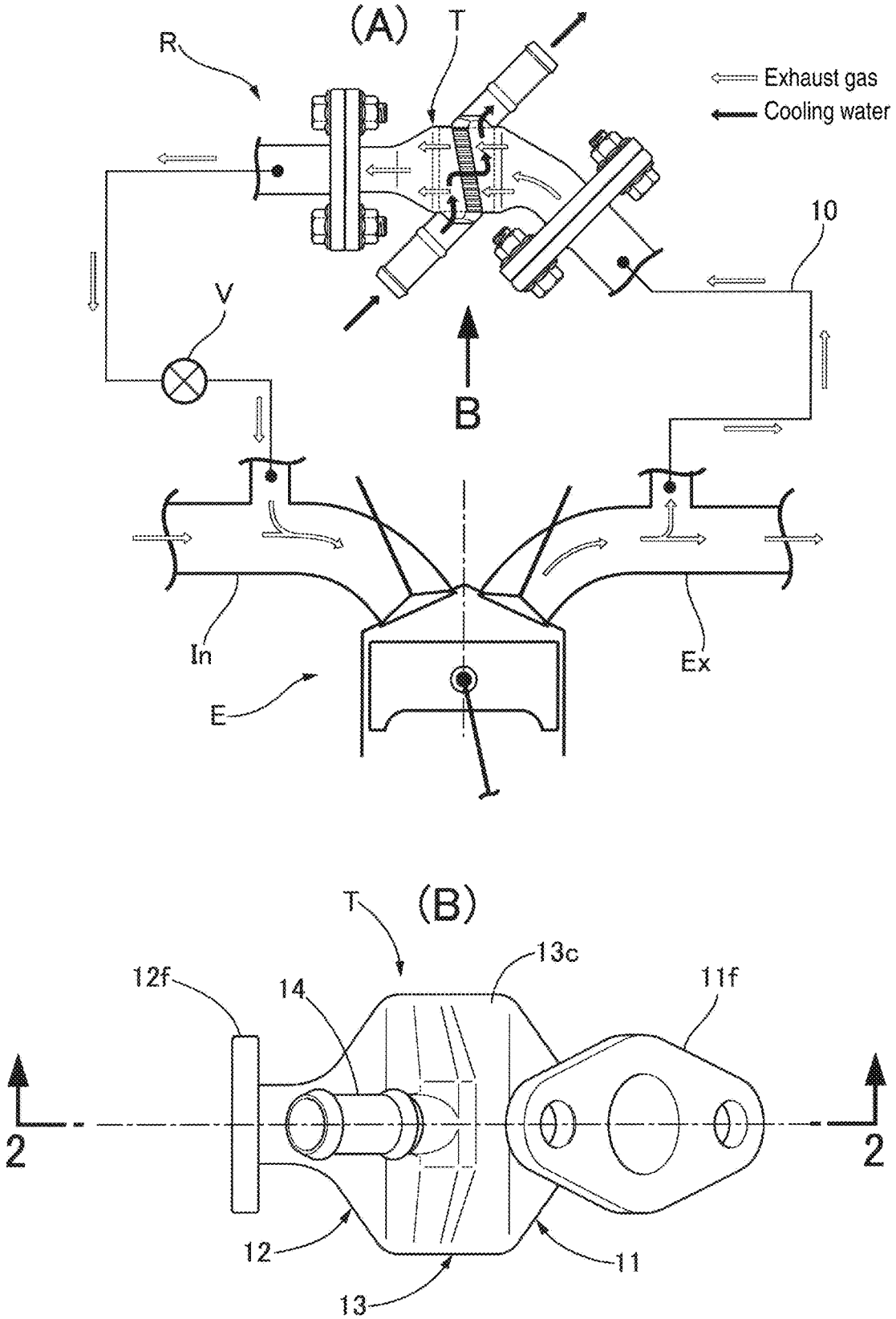
FIG. 1 shows the first embodiment of the heat exchanger according to the disclosure and shows an example in which the heat exchanger is used for cooling EGR (Exhaust Gas Recirculation) gas for an internal combustion engine, wherein (A) is a schematic layout view and (B) is an enlarged bottom view of the heat exchanger (that is, an enlarged view from the arrow B of (A) of FIG. 1).

In FIG. 1, an internal combustion engine E mounted on a vehicle (for example, an automobile) includes an exhaust gas recirculation device R that circulates a part of exhaust gas in an exhaust pipe Ex to an intake pipe In according to an operating condition. That is, an exhaust gas recirculation path 10 is connected between the inside of the exhaust pipe Ex and the inside of the intake pipe In, and in the middle of the exhaust gas recirculation path 10, a heat exchanger T for cooling the recirculated EGR gas (hereinafter, simply referred to as exhaust gas) and a control valve V for controlling the flow rate of the exhaust gas are interposed in series.

Figure 2:
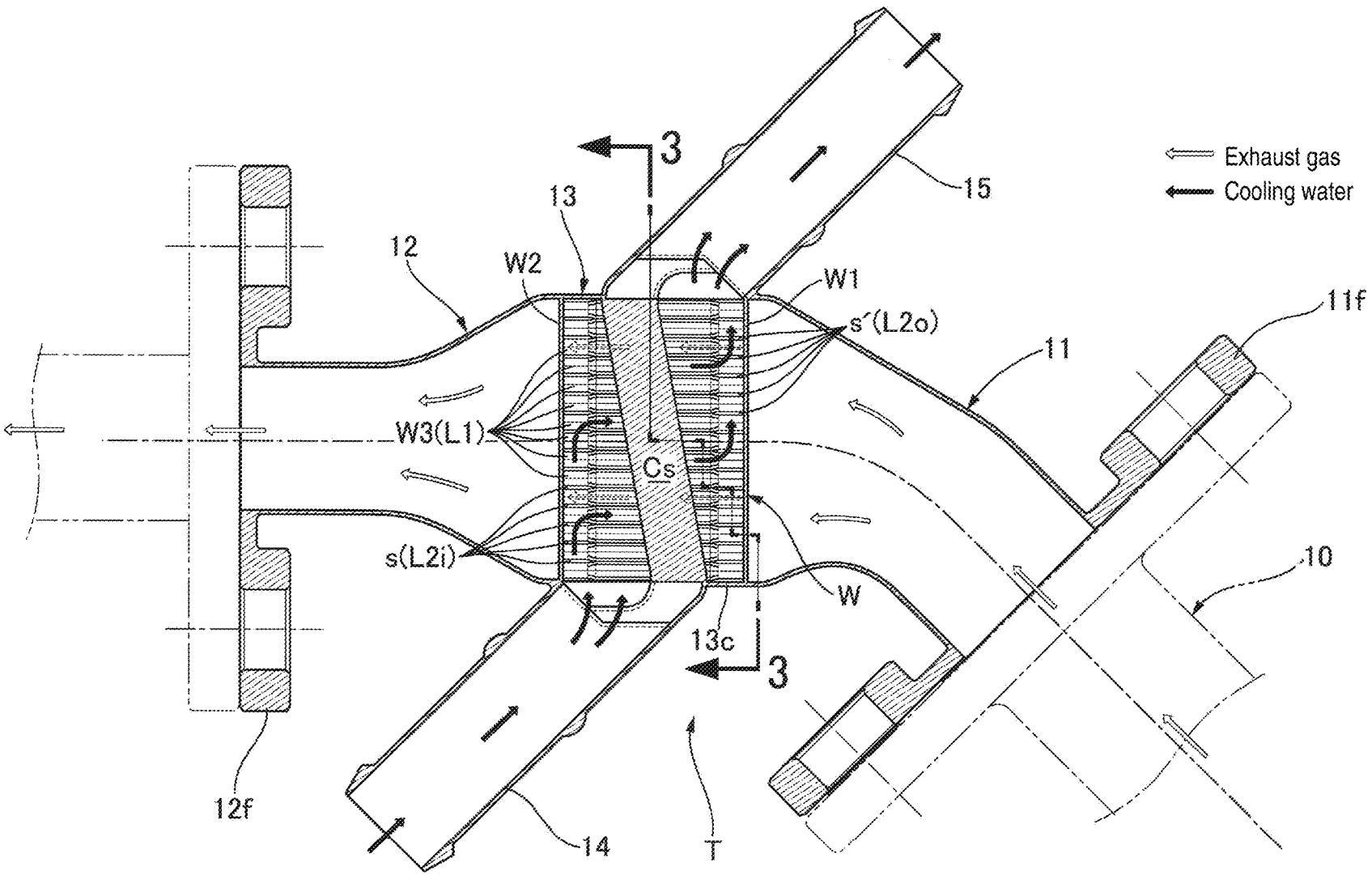
FIG. 2 is a vertical cross-sectional view of the heat exchanger (that is, a reduced cross-sectional view along the line 2-2 of FIG. 3).

Also referring to FIG. 2, the heat exchanger T integrally has an upstream gas pipeline 11 and a downstream gas pipeline 12 that form a part of the exhaust gas recirculation path 10, a heat exchanger main body 13 interposed between the upstream gas pipeline 11 and the downstream gas pipeline 12, and a cooling water inflow pipeline 14 and a cooling water outflow pipeline 15 that respectively protrude on one side and the other side of the outer periphery of the heat exchanger main body 13. The upstream gas pipeline 11 communicates with the exhaust pipe Ex, and the downstream gas pipeline 12 communicates with the intake pipe In.

Connection flange portions 11*f* and 12*f* to be respectively connected to the upstream portion and the downstream portion of the exhaust gas recirculation path 10 are integrally provided at the outer ends of the upstream gas pipeline 11 and the downstream gas pipeline 12, respectively. Furthermore, an upstream pipeline portion and a downstream pipeline portion of a cooling water pipeline (not shown) capable of forcibly circulating the cooling water are connected to the cooling water inflow pipeline 14 and the cooling water outflow pipeline 15, respectively.

In addition, the heat exchanger main body 13 integrally has a case tubular body 13*c* that has a substantially prismatic tubular shape, an upstream end plate W1 that closes one end of the case tubular body 13*c* and faces the downstream end of the upstream gas pipeline 11, and a downstream end plate W2 that closes the other end of the case tubular body 13*c* and faces the upstream end of the downstream gas pipeline 12.

Then, in the heat exchanger main body 13, a large number of first flow paths L1 and a large number of second flow paths L2 are defined. The first flow paths L1 communicate between the upstream gas pipeline 11 and the downstream gas pipeline 12 in parallel to each other, and the second flow paths L2 are disposed adjacent to the first flow paths L1 via a partition wall W and communicate between the cooling water inflow pipeline 14 and the cooling water outflow pipeline 15 in parallel to each other. The structure of the partition wall W that partitions between the first and second flow paths L1 and L2 will be described later.

Therefore, the exhaust gas as a first fluid flowing through the exhaust gas recirculation path 10 can flow and pass through the first flow path L1, and the cooling water as a second fluid can flow and pass through the second flow path L2 from the cooling water inflow pipeline 14. Accordingly, the exhaust gas flowing in the first flow path L1 and the cooling water flowing in the second flow path L2 exchange heat with each other through the partition wall W interposed therebetween, whereby the exhaust gas is cooled.

Next, the structure of the partition wall W described above will be specifically described with reference to FIG. 3 to FIG. 6. The partition wall W includes the upstream end plate W1 that functions as a partition wall portion on the upstream end side in the flow direction of the exhaust gas, the downstream end plate W2 that also functions as a partition wall portion on the downstream end side, and a large number of tubular partition walls W3 that are housed in the case tubular body 13*c* and integrally couple between the upstream end plate W1 and the downstream end plate W2. One end portion W3*a* and the other end portion W3*b* of each of the tubular partition walls W3 are directly open to the inside of the upstream gas pipeline 11 and the inside of the downstream gas pipeline 12 through the upstream end plate W1 and the downstream end plate W2, respectively.

Further, each of the tubular partition walls W3 extends linearly along the flow direction of the exhaust gas (that is, to be orthogonal to the upstream end plate W1 and the downstream end plate W2), and the internal space of each tubular partition wall W3 forms the first flow path L1.

Moreover, at least a part of a large number of tubular partition walls W3 in the first flow path direction (in the embodiment, an intermediate portion W3*m* excluding two end portions W3*a* and W3*b*) are each formed in a star-shaped cross section and are integrally coupled to each other to form a partition wall coupling portion C having a geometric pattern in the transverse cross section. Then, as clearly shown in FIG. 4, the element figures of the geometric pattern include a star-shaped element figure e1 corresponding to the transverse cross-sectional shape of the intermediate portion W3*m* of each of the tubular partition walls W3, and a hexagonal element figure e2 surrounded by a plurality of star-shaped element figures e1.

In the above geometric pattern, each element figure, for example, the star-shaped element figure e1, is connected to each other at the vertex, and is composed of a geometric pattern in which the number of sides of the star-shaped element figures e1 gathering at the vertex thereof is an even number (four in the shown example).

In the partition wall coupling portion C of the embodiment in which such a transverse cross section forms the geometric pattern, the second flow path L2 has a transverse cross section defined in a hexagonal shape (that is, corresponding to the above hexagonal element figure e2) between the outer peripheral surfaces of the star-shaped cross-sectional portions (the above intermediate portions W3*m*) of several tubular partition walls W3 surrounding the second flow path L2. Moreover, in the partition wall coupling portion C, the plurality of first and second flow paths L1 and L2 extend linearly in parallel and adjacent to each other.

Further, each transverse cross section of one end portion W3*a* and the other end portion W3*b* of the tubular partition wall W3 of the embodiment is formed in a hexagonal shape. Moreover, the tubular partition wall W3 is formed so that the flow path cross-sectional shape on each front side of one end portion W3*a* and the other end portion W3*b* gradually and smoothly changes from the star-shaped cross-sectional portion (intermediate portion W3*m*) as clearly shown in FIG. 2 and FIG. 4 to FIG. 6 to the hexagonal cross-sectional portion (one end portion W3*a*, the other end portion W3*b*).

In this case, as clearly shown in FIG. 7, the flow path cross-sectional area of the tubular partition wall W3 is set to be substantially the same in both the star-shaped cross-sectional portion and the hexagonal cross-sectional portion. In other words, as clearly shown in (B) of FIG. 7, the star-shaped cross-sectional portion (intermediate portion W3*m*) and the hexagonal cross-sectional portion (one end portion W3*a*, the other end portion W3*b*) of the tubular partition wall W3 are set to have substantially the same cross-sectional area, that is, a1≈a2, in the portions that do not overlap each other when viewed on the projection plane orthogonal to the tubular partition wall W3.

According to the change of the flow path cross-sectional shape of the tubular partition wall W3 as described above, a first gap s and a second gap s' in the direction orthogonal to the flow path direction of the first flow path L1 are respectively formed between the outer peripheral surfaces of the hexagonal cross-sectional portions at one end portions W3*a* and the other end portions W3*b* of the adjacent tubular partition walls W3.

Then, in the heat exchanger main body 13, as also clearly shown in FIG. 2 to FIG. 6, the second gap s' is developed into a hexagonal mesh to form the outlet space L2*o* of the second flow path L2 and communicate with the cooling water outflow pipeline 15. Further, in the heat exchanger main body 13, as also clearly shown in FIG. 2, FIG. 5, and FIG. 6, the first gap s is developed into a hexagonal mesh similar to the second gap s' to form the inlet space L2*i* of the second flow path L2 and communicate with the cooling water inflow pipeline 14.

Figure 3:
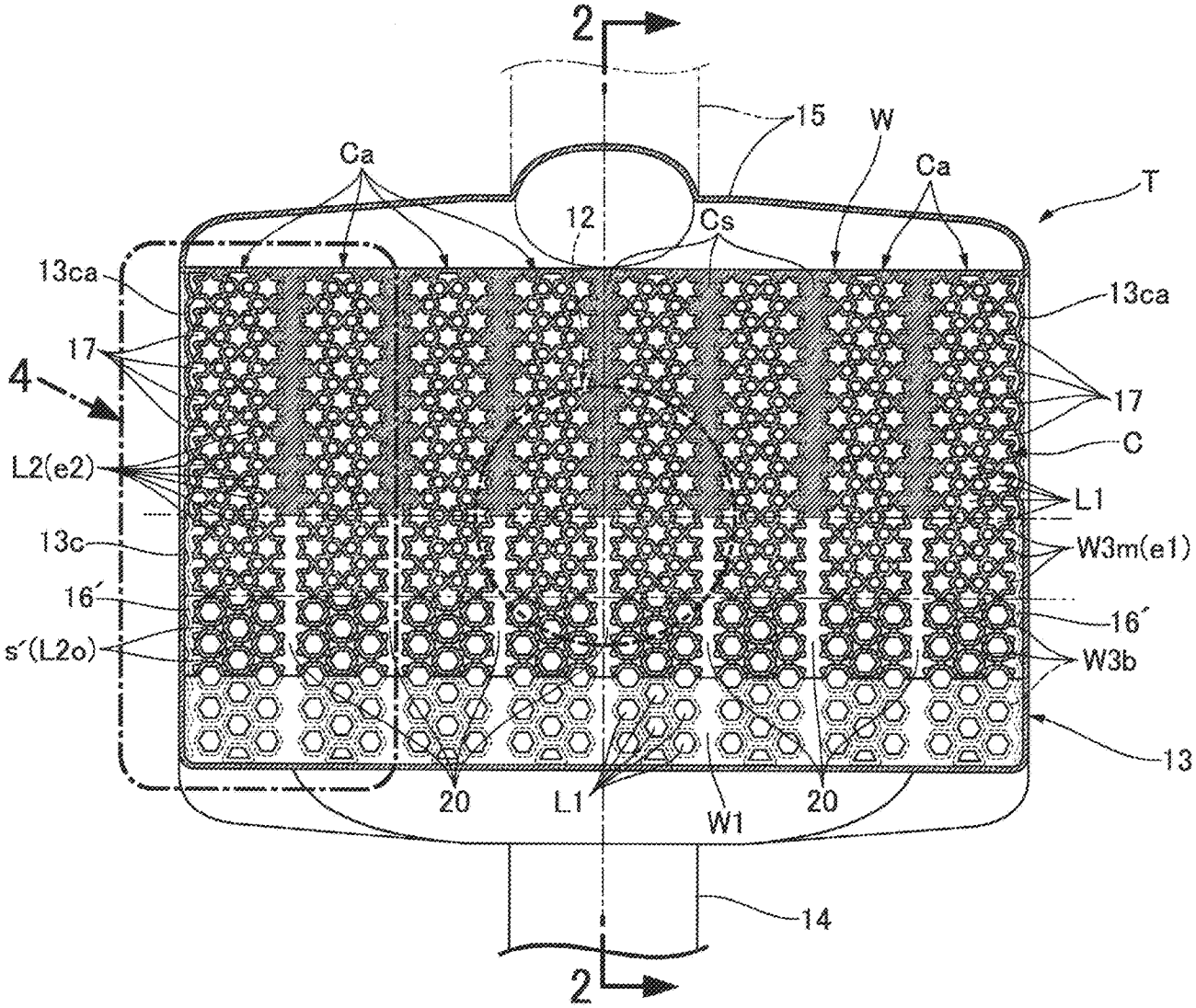
FIG. 3 is an enlarged cross-sectional view along the line 3-3 of FIG. 2.
Figure 4:
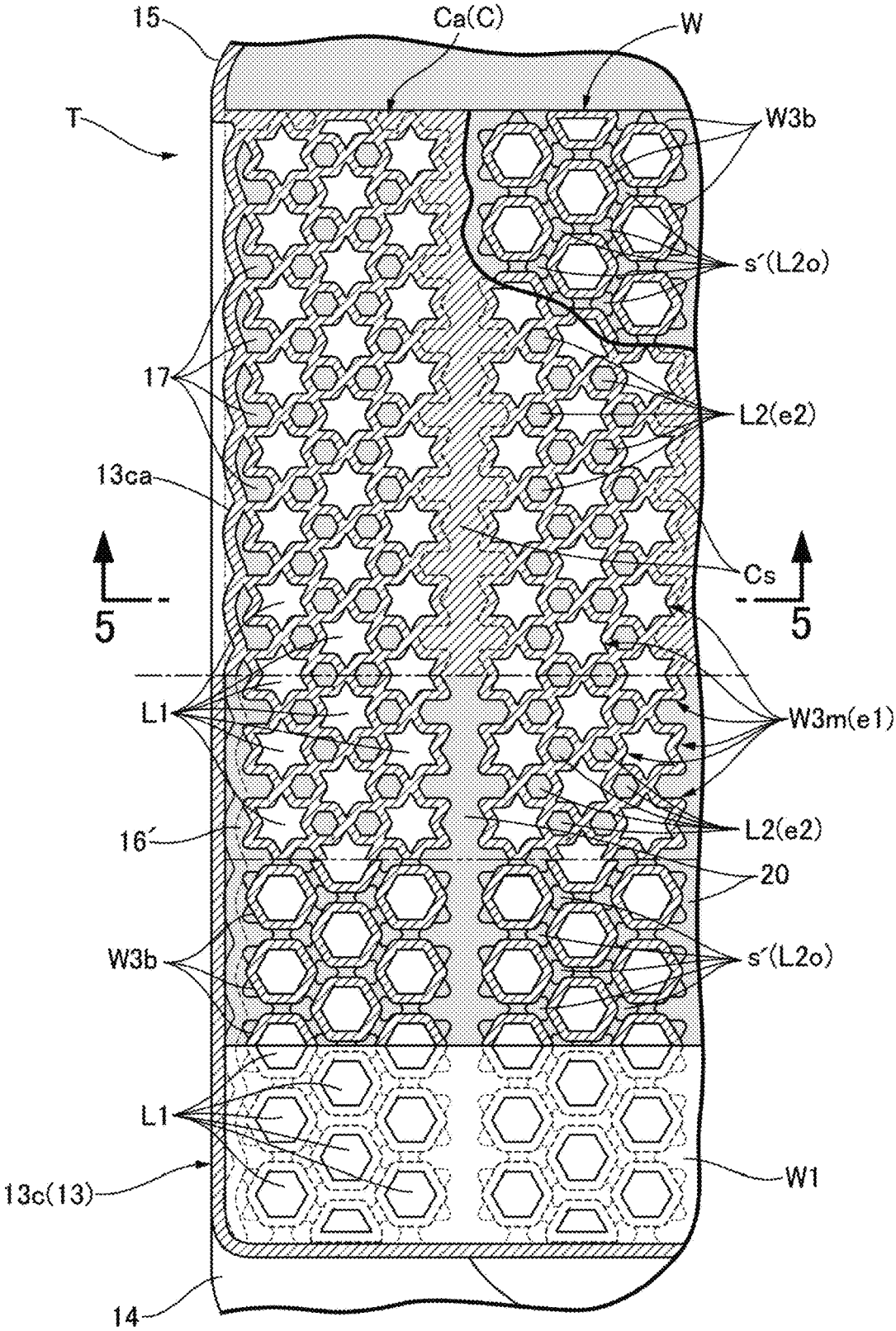
FIG. 4 is an enlarged cross-sectional view of the portion indicated by the arrow 4 of FIG. 3.
Figure 5:
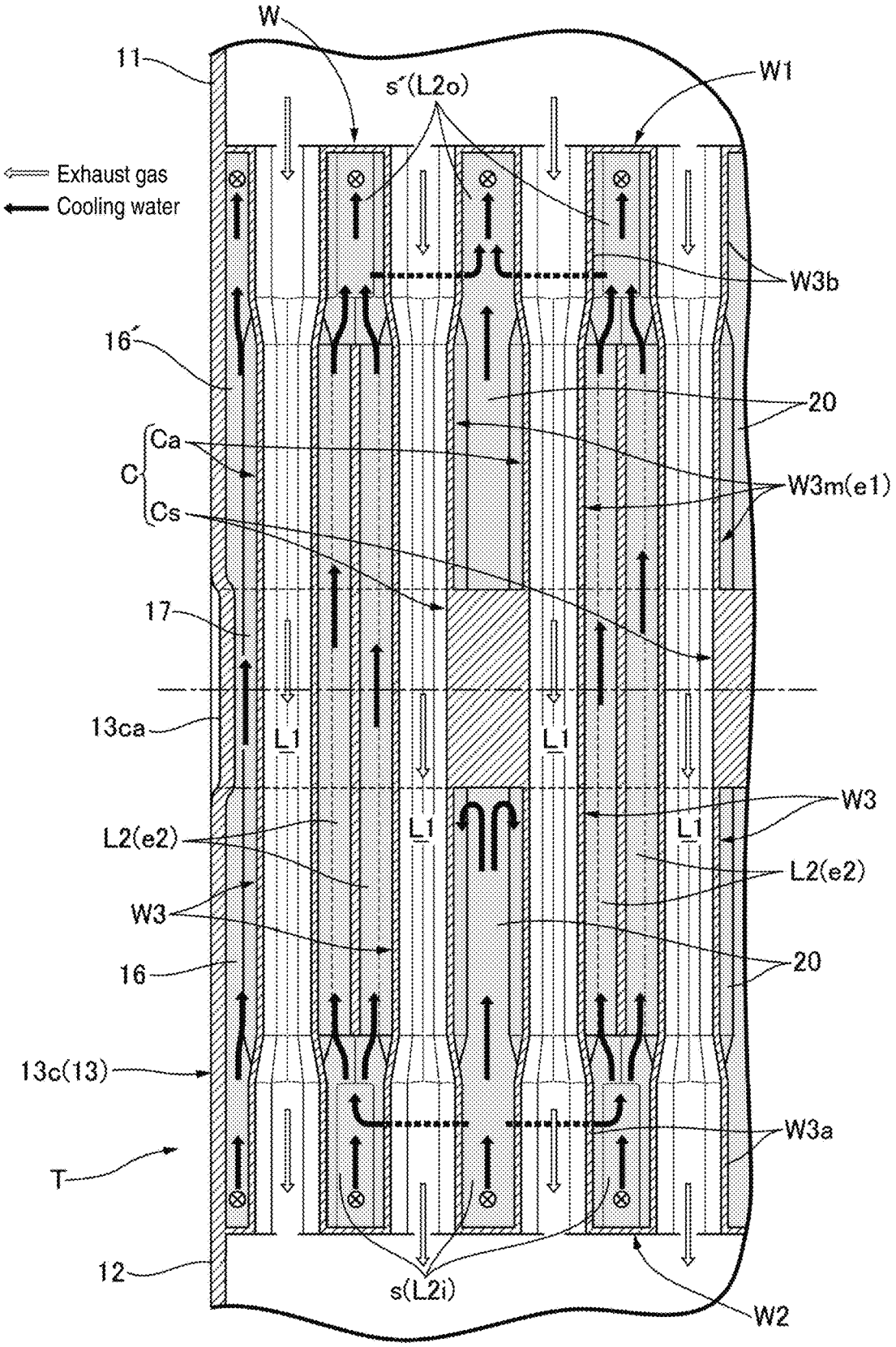
FIG. 5 is an enlarged cross-sectional view along the line 5-5 of FIG. 4.
Figure 6:
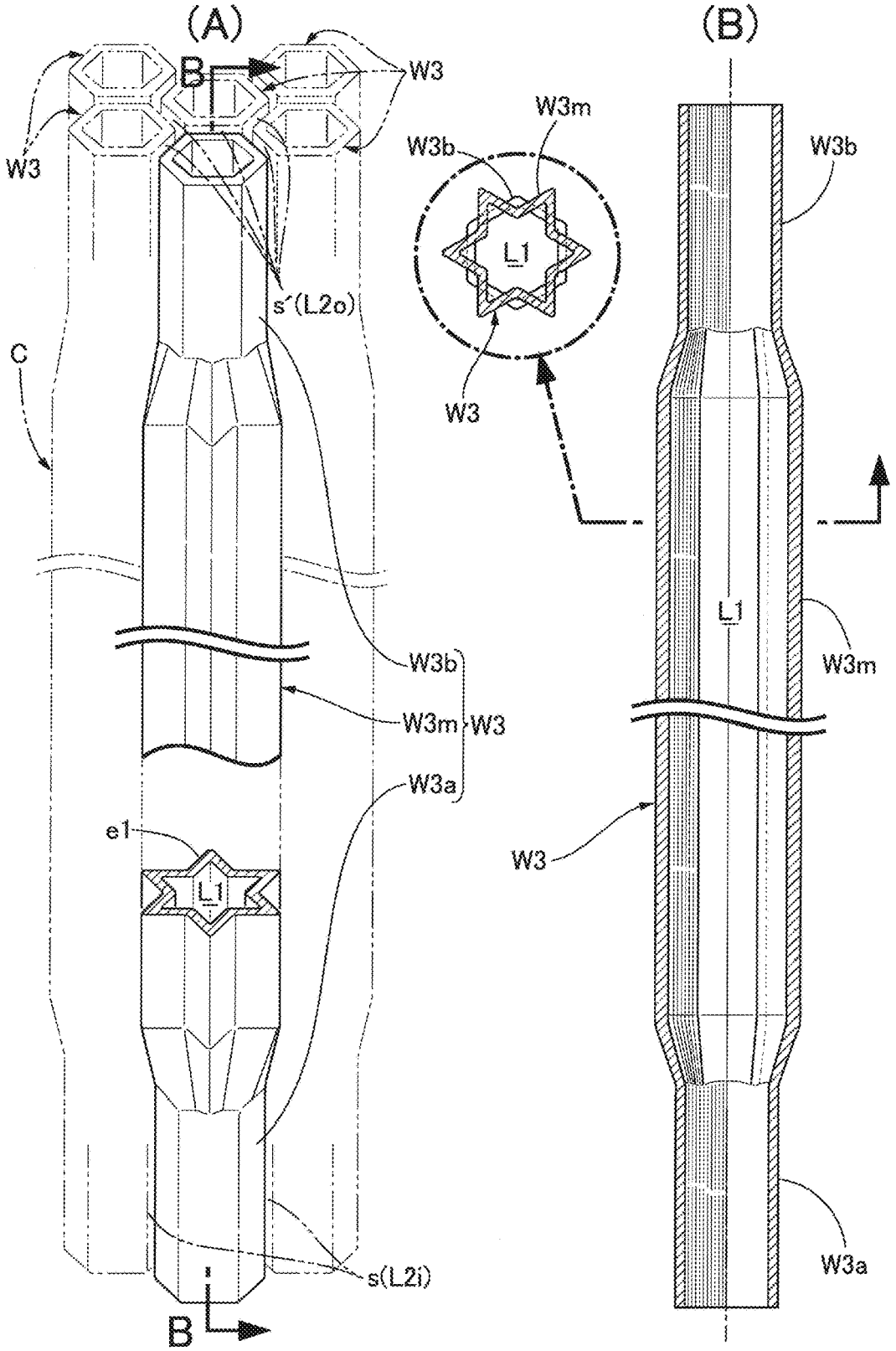
FIG. 6 shows an enlarged structure of one tubular partition wall, wherein (A) is a perspective view and (B) is a vertical cross-sectional view (that is, a cross-sectional view along the line B-B of (A) of FIG. 6) and a transverse cross-sectional view of the main parts.

The partition wall coupling portion C of the embodiment is divided into a plurality of partition wall coupling portion elements Ca adjacent to each other with a flat small gap 20 in between as clearly shown in FIG. 3 to FIG. 5. Then, the flow path direction intermediate portions of the adjacent partition wall coupling portion elements Ca are integrally coupled to each other via a closed wall portion Cs that fills a part of the small gap 20. The closed wall portion Cs functions as a blocking wall that prevents communication (that is, short circuit) through the small gap 20 between the inlet space L2*i* and the outlet space L2*o* described above.

Further, in particular, as clearly shown in FIG. 2, the closed wall portion Cs of the embodiment is configured to be inclined with respect to the direction orthogonal to the second flow path direction so that the width of the inlet space L2*i* in the second flow path direction (that is, the longitudinal direction of the second flow path L2, and therefore the left-right direction in FIG. 2) increases as it is closer to the cooling water inflow pipeline 14, and the width of the outlet space L2*o* in the second flow path direction increases as it is closer to the cooling water outflow pipeline 15.

Therefore, configuring the closed wall portion Cs of the embodiment to be inclined as described above has the advantages that the frontage from the cooling water inflow pipeline 14 to the side of the inlet space L2*i* is widened to help the cooling water of the cooling water inflow pipeline 14 smoothly flow into the inlet space L2*i*, and the frontage from the outlet space L2*o* to the side of the cooling water outflow pipeline 15 is also widened to help the cooling water of the outlet space L2*o* smoothly flow out to the cooling water outflow pipeline 15.

In addition, as clearly shown in FIG. 4 and FIG. 5, between the group of the outermost tubular partition walls W3 in the partition wall coupling portion elements Ca on both outer sides and the case tubular body 13*c* covering the outer surfaces thereof, first and second flat water paths 16 and 16' respectively communicating with the first and second gaps s and s' described above are defined, and the flat water paths 16 and 16' also function as a part of the inlet space L2*i* and the outlet space L2*o*.

Further, a part of the case tubular body 13*c*, particularly a portion corresponding to the closed wall portion Cs, is formed with a band-shaped corrugated plate portion 13*ca* curved in a transverse cross-sectional waveform, and as clearly shown in FIG. 4, the band-shaped corrugated plate portion 13*ca* is close to the outermost tubular partition wall W3 and has a part integrally connected to the tubular partition wall W3. Between the band-shaped corrugated plate portion 13*ca* and the intermediate portion W3*m* (star-shaped cross-sectional portion) of the outermost tubular partition wall W3, a plurality of deformed water paths 17 having a flow path cross section narrower than the flat water paths 16 and 16' are defined in parallel to each other. The deformed water paths 17 communicate between the first and second flat water paths 16 and 16' and can exhibit the same water path function as the intermediate portion (hexagonal cross-sectional portion) of the second flow path L2.

The band-shaped corrugated plate portion 13*c* a is formed to overlap the closed wall portion Cs (that is, to be inclined in the same manner as the closed wall portion Cs) in the side view of the case tubular body 13*c* (that is, when viewed in the direction orthogonal to the paper surface of FIG. 2). Nevertheless, instead of forming the deformed water path 17, the water path portion may be integrally filled with the closed wall portion Cs.

Moreover, in the heat exchanger T of the embodiment, the heat exchanger main body 13 integrally having the above-mentioned partition wall W, and the upstream/downstream gas pipelines 11 and 12 and the cooling water inflow/outflow pipelines 14 and 15 are integrally molded by metal lamination molding. Here, the metal lamination molding is a conventionally known molding technique in which metal powder is melted by an electron beam or a fiber laser and then laminated and solidified to produce a metal part, and is a method for molding a metal member having a three-dimensionally complicated shape and for forming a fine and precise 3D shape.

Thus, in the heat exchanger T of the embodiment, not only the partition wall W including the partition wall coupling portion C, which has a geometric pattern in the transverse cross section and has a complicated three-dimensional form, but also the entire heat exchanger T can be integrally molded accurately by using the metal lamination molding method. In addition, it is also possible to integrally mold only the heat exchanger main body 13 that integrally includes the partition wall W by metal lamination molding, and fix (for example, weld) the upstream/downstream gas pipelines 11 and 12 and the cooling water inflow/outflow pipelines 14 and 15 manufactured separately to the molded product.

Next, the operation of the embodiment will be described.

When the control valve V of the exhaust gas recirculation device R is opened during the operation of the internal combustion engine E, a part of the exhaust gas in the exhaust pipe Ex flows toward the intake pipe In through the exhaust gas recirculation path 10, and is cooled in the heat exchanger T on the way. That is, the exhaust gas becomes a parallel flow and flows linearly in a large number of tubular partition walls W3 in the heat exchanger T, that is, the first flow paths L1, and meanwhile the cooling water flowing from the cooling water inflow pipeline 14 into the inlet space L2*i* of the second flow path L2 in the heat exchanger T flows in the direction opposite to the exhaust gas flow of the first flow path L1 through the linear flow path portion of the second flow path L2 surrounded by the plurality of first flow paths L1 in the partition wall coupling portion C. At this time, the exhaust gas in the first flow path L1 and the cooling water in the second flow path L2 exchange heat via the tubular partition wall W3, and the exhaust gas is efficiently cooled.

In the heat exchanger T of the embodiment, a part (that is, the flow path direction intermediate portions W3*m*) of a large number of tubular partition walls W3, which form the main part of the partition wall W and whose inside is the passage for the exhaust gas (first flow path L1), are integrally coupled to each other to form the partition wall coupling portion C having a geometric pattern in the transverse cross section. Then, the element figures e1 of the geometric pattern (that is, corresponding to the star-shaped cross-sectional shape of the intermediate portion W3*m*) are connected to each other at the vertices of the element figures e1, and the number of the sides of the element figure e1 gathering at the vertex thereof is set to an even number (four in the embodiment). Moreover, as clearly shown in FIG. 3 and FIG. 4, in the partition wall coupling portion C, the second flow path L2 is defined between the outer peripheral surfaces of the intermediate portions W3*m* (star-shaped cross-sectional portions) of the plurality of tubular partition walls W3 surrounding the second flow path L2, and is formed as a linear water path having a hexagonal shape in the transverse cross section.

Therefore, in the partition wall coupling portion C, the plurality of tubular partition walls W3 are connected in all directions in the transverse cross section and integrated to form sturdy wall structures that reinforce each other so the rigidity and strength can be effectively increased as a whole. As a result, for example, even when the tubular partition wall W3 is made thinner to make the flow path cross section finer in order to improve the heat transfer performance, the rigidity and strength of the tubular partition wall W3 can be sufficiently secured. Therefore, there is no problem with the strength even in a case of a large pressure difference between the first and second flow paths L1 and L2.

Thus, it is possible to provide an extremely high-performance heat exchanger T that can secure sufficient heat transfer performance and rigidity and strength and can also achieve compactness and weight reduction.

Further, in particular, by changing the respective flow path cross-sectional shapes on the front sides of one end portion W3*a* and the other end portion W3*b* of each of the plurality of tubular partition walls W3 from the star-shaped cross-sectional portion (intermediate portion W3*m*) to the hexagonal cross-sectional portion (one end portion W3*a* and the other end portion W3*b*), the first gap s and the second gap s' in the direction orthogonal to the flow path direction of the first flow path L1 are respectively formed between the outer peripheral surfaces of the hexagonal cross-sectional portions at one end portion W3*a* and the other end portion W3*b* of the adjacent tubular partition walls W3, and the first gap s forms the inlet space L2*i* of the second flow path L2 and the second gap s' forms the outlet space L2*o* of the second flow path L2.

As a result, the cooling water flowing from the cooling water inflow pipeline 14 (that is, one side of the first flow path L1) into the inlet space L2*i* of the second flow path L2 smoothly flows in the first gap s and in the small gap 20 communicating therewith while bypassing the periphery of the first flow path L1 (that is, one end portion W3*a* of the tubular partition wall W3), and finally flows straight through the hexagonal cross-sectional portion of the second flow path L2 that extends linearly in the partition wall coupling portion C to reach the outlet space L2*o* of the second flow path L2. Further, the cooling water smoothly flows in the second gap s' and in the small gap 20 communicating therewith while bypassing the periphery of the first flow path L1 (that is, the other end portion W3*b* of the tubular partition wall W3), and finally flows out to the cooling water outflow pipeline 15 (that is, the other side of the first flow path L1).

Thus, according to the partition wall structure of the embodiment, in particular, in the partition wall coupling portion C, since the first and second flow paths L1 and L2 can be extended in parallel and linearly with each other, the pressure loss in each flow path can be sufficiently reduced. In this case, in the embodiment, because the exhaust gas and the cooling water respectively flowing in the first and second flow paths L1 and L2 are opposite flows, that is, counterflows, the heat exchange efficiency between the two fluids can be further improved.

Moreover, the first gap s and the second gap s' can be respectively formed between the outer peripheral surfaces of one end portion W3*a* and the other end portion W3*b* of the adjacent tubular partition walls W3 simply by changing the flow path cross-sectional shapes on the front sides of one end portion W3*a* and the other end portion W3*b* of the tubular partition wall W3 as described above, and the first gap s and the second gap s' can be used as the inlet space L2*i* and the outlet space L2*o* of the second flow path L2 that allows the cooling water to flow in and out from the side of the first flow path L1. Therefore, the cooling water can smoothly enter and exit the second flow path L2 even from the side of the first flow path L1. Further, in particular, since the exhaust gas as the first fluid has a straight flow over the entire area from the inlet end to the outlet end of the first flow path L1, the pressure loss of the exhaust gas flow passing through the first flow path L1 is minimized.

Thus, since the heat exchanger T of the embodiment can effectively reduce the pressure loss at the inlet and outlet of the first and second flow paths L1 and L2 as compared with the conventional plate-type heat exchanger, the heat exchanger T can greatly contribute to significant reduction of the pressure loss of each fluid.

Furthermore, since the partition wall coupling portion C of the embodiment is divided into a plurality of partition wall coupling portion elements Ca adjacent to each other with the small gap 20 in between, the small gap 20 becomes a water path connected to the second flow path L, and the fluidity of the cooling water in the inlet space L2*i* and the outlet space L2*o* of the second flow path L2 is enhanced, whereby the pressure loss of the cooling water flow in the second flow path L2 can be reduced. In addition, because the adjacent partition wall coupling portion elements Ca are coupled by the closed wall portion Cs, the closed wall portion Cs can reliably prevent a short circuit between the inlet space L2*i* and the outlet space L2*o* of the second flow path L2 via the small gap 20, and as a result, the cooling water can flow reliably even in the intermediate portion in the longitudinal direction (that is, hexagonal cross-sectional portion) of the second flow path L2.

Further, FIG. 8 shows several modified examples of the tubular partition wall W3. In the first modified example of (A) of FIG. 8, a protrusion 25 that can promote heat transfer of the exhaust gas as the first fluid flowing in the tubular partition wall W3 is integrally provided on the inner surface of at least the intermediate portion W3*m* (that is, the star-shaped cross-sectional portion) of the tubular partition wall W3 in the partition wall coupling portion C. A plurality of the protrusions 25 are arranged on one half-circumferential side and the other half-circumferential side of the tubular partition wall W3 and are alternately arranged in the flow path direction. According to the protruding configuration of the protrusions 25, the exhaust gas flowing in the tubular partition wall W3 (that is, the first flow path L1) is caused to have a turbulent flow to some extent, whereby the heat transfer coefficient can be improved while an increase in pressure loss is suppressed as much as possible.

In addition, in the second modified example of the tubular partition wall W3 shown in (B) of FIG. 8, at least the intermediate portion W3*m* of the tubular partition wall W3 is undulated in a wave form with respect to the flow path direction and formed in the partition wall coupling portion C. Thus, the first and second flow paths L1 and L2 are gently curved in a wave form and turned, and as a result, a turbulent flow is generated in the passing fluid to some extent, whereby the heat transfer coefficient can be improved while an increase in pressure loss is suppressed as much as possible.

Further, in the third modified example of the tubular partition wall W3 shown in (C) of FIG. 8, at least the intermediate portion W3*m* of the tubular partition wall W3 is undulated in a gentle herringbone form (in other words, a gentle bellows shape) with respect to the flow path direction and is formed in the partition wall coupling portion C. Thus, the flow path cross-sectional areas of the first and second flow paths L1 and L2 are gradually increased or decreased, and as a result, a turbulent flow is generated in the passing fluid to some extent, whereby the heat transfer coefficient can be improved while an increase in pressure loss is suppressed as much as possible.

In the embodiment, by changing the flow path cross-sectional shapes on the front sides of one end portion W3*a* and the other end portion W3*b* of the tubular partition wall W3, each of the plurality of tubular partition walls W3 respectively form the first and second gaps s and s' in the direction orthogonal to the flow path direction of the first flow path L1 between the outer peripheral surfaces of one end portions W3*a* and the other end portions W3*b* of the adjacent tubular partition walls W3, and the cooling water flows in from one side of the first flow path L1 and flow out to the other side through the inlet space L1*i* and the outlet space L2*o* of the second flow path L2 formed by the first and second gaps s and s'.

In contrast thereto, in the fourth modified example shown in (A) of FIG. 9, the cooling water is configured to flow in and out from one side (that is, the same side) of the first flow path L1 through the inlet space L1*i* and the outlet space L2*o* of the second flow path L2. However, the fourth modified example is limited to the case where a space sufficient for protruding the cooling water inflow pipeline 14 and the cooling water outflow pipeline 15 can be secured on the same side surface of the heat exchanger main body 13. Therefore, according to the above embodiment and the fourth modified example, since the exhaust gas flowing through the first flow path L1 has a straight flow over the entire area, the pressure loss can be reduced.

Further, in the embodiment and the fourth modified example, among the first and second flow paths L1 and L2, only the second flow path L2 turns the inflow/outflow direction of the fluid laterally. However, as in a fifth modified example shown in (B) of FIG. 9, not only the second flow path L2 but also the first flow path L1 may turn the inflow or outflow direction of the fluid laterally. That is, the fifth modified example shows a partition wall structure that turns any (outflow direction in the illustrated example) of the inflow and outflow directions of the exhaust gas flowing through the first flow path L1 laterally and turns any (outflow direction in the illustrated example) of the inflow and outflow directions of the cooling water flowing through the second flow path L2 laterally.

Furthermore, FIG. 10 shows the second embodiment of the disclosure. In the second embodiment, the transverse cross section of the partition wall coupling portion C is also formed in a geometric pattern, but as clearly shown in (A) of FIG. 10, the element figures of the geometric pattern have the same rectangular shape (square in the illustrated example), and these are arranged vertically and horizontally to form a grid-shaped geometric pattern. Therefore, each of the plurality of first and second flow paths L1 and L2 has the same rectangular shape in the transverse cross section, and extends in parallel and linearly with each other.

Then, the adjacent ones of a plurality of tubular partition walls W3 forming the first flow paths L1 inside are integrally coupled to each other over the entire area in the longitudinal direction to form the partition wall coupling portion C, and the partition wall coupling portion C is housed and fixed in the heat exchanger main body 13. In the partition wall coupling portion C, one end portion and the other end portion of the adjacent first flow paths L1 in the flow path direction are integrally connected via the U-shaped first connection portions 41 and 41' respectively so that the plurality of first flow paths L1 (tubular partition walls W3) are connected in series with each other to form a first single flow path SL1 (single path). Moreover, one end portion and the other end portion of the adjacent second flow paths L2 in the flow path direction are integrally connected via the U-shaped second connection portions 42 and 42' respectively so that the plurality of second flow paths L2 are connected in series with each other to form a second single flow path SL2 (single path).

Then, an outlet tubular portion SL1*o*, which is the outlet of the first single flow path SL1, and an inlet tubular portion SL2*i*, which is the inlet of the second single flow path SL2, integrally protrude on one side portion of the partition wall coupling portion C. In addition, an inlet tubular portion SL1*i*, which is the inlet of the first single flow path SL1, and an outlet tubular portion SL2*o*, which is the outlet of the second single flow path SL2, integrally protrude on the other side portion of the partition wall coupling portion C. Thus, as clearly shown in (C) of FIG. 10, in at least a partial region of the partition wall coupling portion C, the exhaust gas (first fluid) and the cooling water (second fluid) flow in opposite directions in the adjacent first and second flow paths L1 and L2.

As described above, according to the second embodiment, in the partition wall coupling portion C, one end portions and the other end portions of the adjacent first flow paths L1 in the flow path direction are connected to each other so that the plurality of first flow paths L1 are connected in series with each other to form the first single flow path SL1, and one end portions and the other end portions of the adjacent second flow paths L2 in the flow path direction are connected to each other so that the plurality of second flow paths L2 are connected in series with each other to form the second single flow path SL2. As a result, even for the partition wall coupling portion C that has a geometric pattern in the transverse cross section, the plurality of first and second flow paths L1 and L2 respectively become the connected first and second single flow paths SL1 and SL2 (single paths) so the flow velocity can be increased to increase the thermal conductivity in particular when the flow rate is small.

Moreover, as described above, in at least a partial region of the partition wall coupling portion C, the exhaust gas (first fluid) and the cooling water (second fluid) flow in opposite directions in the adjacent first and second flow paths L1 and L2. Therefore, even if the first and second flow paths L1 and L2 form the single flow paths SL1 and SL2 (single paths), the first and second fluids respectively flowing through them are counterflows, and the heat exchange efficiency between the two fluids can be improved.

Although the embodiments of the disclosure have been described above, the disclosure is not limited thereto, and various design changes can be made without departing from the gist thereof.

For example, the above embodiment illustrates that in the exhaust gas recirculation device for an internal combustion engine, the heat exchanger of the disclosure is used for cooling the exhaust gas (EGR gas), but the application of the heat exchanger is not limited to the embodiment, and the heat exchanger may be used for any application for heat exchange between the first and second fluids via the partition wall. Furthermore, regardless of whether the first and second fluids are liquids or gases, the heat exchanger may be used for heat exchange between liquids or for heat exchange between gases.

In addition, the first embodiment illustrates that the partition wall coupling portion C that has the geometric pattern in the transverse cross section is divided into the plurality of partition wall coupling portion elements Ca adjacent to each other with the flat small gap 20 in between, and the flow path direction intermediate portions of the adjacent partition wall coupling portion elements Ca are integrally coupled to each other via the closed wall portion Cs, but another embodiment can also be implemented in which the partition wall coupling portion C is not divided into the plurality of partition wall coupling portion elements Ca (that is, the small gap 20 and the closed wall portion Cs are omitted).

Further, the first embodiment illustrates that the transverse cross section of the partition wall coupling portion C has the geometric pattern in which the element figures are a combination of the star-shaped element figures e1 and the hexagonal element figures e2, and the second embodiment illustrates that the element figure has a rectangular shape. However, the geometric pattern of the partition wall coupling portion C of the disclosure can be implemented as various combinations of element figures as long as the sides of the element figure gathering at the vertex of the element figure are even, and some examples of variations thereof are shown in FIG. 11.

That is, (a) of FIG. 11 is a schematic representation of the geometric pattern of the first embodiment, whereas (b) of FIG. 11 illustrates that the element figure is an equilateral triangle, (c) of FIG. 11 illustrates that the element figure is a cross, (d) of FIG. 11 illustrates that the element figure is a combination of a regular hexagon, a square, and an equilateral triangle, (e) of FIG. 11 illustrates that the element figure is a combination of a regular hexagon and an equilateral triangle, and (f) of FIG. 11 illustrates that the element figure is a parallelogram.

What is claimed is:

1. A heat exchanger, in which a partition wall (W) is interposed between a plurality of first flow paths (L1) through which a first fluid flows and a plurality of second flow paths (L2) through which a second fluid flows, and heat exchange is performed between the first fluid and the second fluid through the partition wall (W), wherein the partition wall (W) comprises a plurality of tubular partition walls (W3) inside of which is the first flow paths (L1) and which are arranged in parallel to each other, at least a part of the plurality of tubular partition walls (W3) in a flow path direction are integrally coupled to each other to form a partition wall coupling portion (C) having a geometric pattern in a transverse cross section, by changing a flow path cross-sectional shape on a front side of at least one end portion (W3*a*, W3*b*) of the tubular partition wall (W3), each of the plurality of tubular partition walls (W3) forms a gap (s, s') in a direction orthogonal to a flow path direction of the first flow paths (L1) between outer peripheral surfaces of the one end portions (W3*a*, W3*b*) of the adjacent tubular partition walls (W3), and an intermediate portion (W3*m*) of the tubular partition wall (W3) and the at least one end portion (W3*a*, W3*b*) of the tubular partition wall (W3) have substantially the same cross-sectional area, wherein the partition wall coupling portion (C) is divided into a plurality of partition wall coupling portion elements (Ca) adjacent to each other with another gap (20) in between, flow path direction intermediate portions of the adjacent partition wall coupling portion elements (Ca) are integrally coupled to each other via a closed wall portion (Cs) that fills a part of the another gap (20), and the closed wall portion (Cs) blocks communication between the inlet space (L2*i*) and the outlet space (L2*o*) via the another gap (20).

2. The heat exchanger according to claim 1, wherein the gap (s, s') forms an inlet space (L2*i*) or an outlet space (L2*o*) of the second flow paths (L2) which allows the second fluid to flow in or flow out from a side of the first flow paths (L1), and in an intermediate portion of the partition wall (W), the first and second flow paths (L1, L2) extend in parallel and linearly with each other.

3. The heat exchanger according to claim 2, wherein in the intermediate portion of the partition wall (W), the first fluid becomes a parallel flow and flows in one direction in the plurality of first flow paths (L1), and the second fluid becomes a parallel flow and flows in the other direction in the plurality of second flow paths (L2).

4. The heat exchanger according to claim 1, wherein in the partition wall coupling portion (C), one end portions and the other end portions of the adjacent first flow paths (L1) in the flow path direction are respectively connected to each other so that the plurality of first flow paths (L1) are connected in series with each other to form a first single flow path (SL1), and one end portions and the other end portions of the adjacent second flow paths (L2) in the flow path direction are respectively connected to each other so that the plurality of the second flow paths (L2) are connected in series with each other to form a second single flow path (SL2).

5. The heat exchanger according to claim 4, wherein in at least a partial region of the partition wall coupling portion (C), the first and second fluids flow in opposite directions in the adjacent first and second flow paths (L1, L2).

6. The heat exchanger according to claim 1, wherein the tubular partition wall (W3) integrally has a protrusion (25) that protrudes into the first flow path (L1) for promoting heat transfer of the first fluid.

7. The heat exchanger according to claim 1, wherein at least a part of the tubular partition wall (W3) is undulated with respect to the flow path direction.

8. The heat exchanger according to claim 1, wherein by changing a flow path cross-sectional shape on each front side of one end portion (W3*a*) and the other end portion (W3*b*) of the tubular partition wall (W3), each of the plurality of tubular partition walls (W3) forms the gap, wherein the gap comprises a first gap (s) and a second gap (s') in the direction orthogonal to the flow path direction of the first flow paths (LI) between outer peripheral surfaces of the one end portions (W3*a*) and the other end portions (W3*b*) of the adjacent tubular partition walls (W3), the first gap (s) forms an inlet space (L2*i*) of the second flow paths (L2), and the second gap (s') forms an outlet space (L2*o*) of the second flow paths (L2), and in an intermediate portion of the partition wall (W), the first and second flow paths (L1, L2) extend in parallel and linearly with each other.

9. The heat exchanger according to claim 1, wherein all of the partition wall (W) comprising the partition wall coupling portion (C) is integrally molded by metal lamination molding.

10. The heat exchanger according to claim 2, wherein all of the partition wall (W) comprising the partition wall coupling portion (C) is integrally molded by metal lamination molding.

11. The heat exchanger according to claim 3, wherein all of the partition wall (W) comprising the partition wall coupling portion (C) is integrally molded by metal lamination molding.

12. The heat exchanger according to claim 4, wherein all of the partition wall (W) comprising the partition wall coupling portion (C) is integrally molded by metal lamination molding.

13. The heat exchanger according to claim 5, wherein all of the partition wall (W) comprising the partition wall coupling portion (C) is integrally molded by metal lamination molding.

14. The heat exchanger according to claim 6, wherein all of the partition wall (W) comprising the partition wall coupling portion (C) is integrally molded by metal lamination molding.

15. The heat exchanger according to claim 7, wherein all of the partition wall (W) comprising the partition wall coupling portion (C) is integrally molded by metal lamination molding.

16. The heat exchanger according to claim 8, wherein all of the partition wall (W) comprising the partition wall coupling portion (C) is integrally molded by metal lamination molding.

* * * * *